US007013529B2

(12) United States Patent
Pettit et al.

(10) Patent No.: US 7,013,529 B2
(45) Date of Patent: Mar. 21, 2006

(54) BLOCK AND TACKLE SASH BALANCE BRAKE ASSEMBLY

(75) Inventors: Dean Pettit, St. John, IN (US); Mark Eenigenburg, Lansing, IL (US)

(73) Assignee: Newell Operating Company, Atlanta, GA (US)

( * ) Notice: Subject to any disclaimer, the term of this patent is extended or adjusted under 35 U.S.C. 154(b) by 40 days.

(21) Appl. No.: 10/277,258

(22) Filed: Oct. 22, 2002

(65) Prior Publication Data

US 2003/0074764 A1 Apr. 24, 2003

Related U.S. Application Data

(60) Provisional application No. 60/347,640, filed on Oct. 23, 2001.

(51) Int. Cl.
*E05D 15/22* (2006.01)

(52) U.S. Cl. ..... 16/197; 16/193; 49/181; 49/447

(58) Field of Classification Search ..... 16/197, 16/193, 200, 194; 49/181, 176, 445, 447; 292/210, 238, 230, 229, 304, 300, DIG. 61, 292/DIG. 20
See application file for complete search history.

(56) References Cited

U.S. PATENT DOCUMENTS

| | | | | |
|---|---|---|---|---|
| 1,007,212 | A | 10/1911 | Lasersohn | |
| 1,312,665 | A | 8/1919 | Almquist | |
| 2,178,533 | A | 10/1939 | Viehweger | |
| 2,952,884 | A | 9/1960 | Dinsmore | |
| 2,987,758 | A * | 6/1961 | Osten, Sr. | 16/197 |
| 3,007,194 | A | 11/1961 | Griswold | |
| 3,280,511 | A * | 10/1966 | Johnson | 49/446 |
| 3,497,999 | A | 3/1970 | Hendra | |
| 3,676,956 | A | 7/1972 | Taylor et al. | |
| 3,732,594 | A | 5/1973 | Mills | |
| 3,869,754 | A | 3/1975 | Foster | |
| 4,068,406 | A | 1/1978 | Wood | |
| 4,079,549 | A | 3/1978 | Wood | |
| 4,089,085 | A | 5/1978 | Fitzgibbon | |
| 4,190,930 | A | 3/1980 | Prosser | |
| 4,300,316 | A | 11/1981 | Ficurilli | |
| 4,332,054 | A | 6/1982 | Paist et al. | |
| 4,506,478 | A | 3/1985 | Anderson | |
| 4,510,713 | A | 4/1985 | Anderson | |
| 4,610,108 | A | 9/1986 | Marshik | |
| 4,697,304 | A | 10/1987 | Overgard | |
| 4,887,389 | A * | 12/1989 | Haltof | 49/181 |
| 4,930,254 | A | 6/1990 | Valentin | |
| 4,941,285 | A | 7/1990 | Westfall | |
| 4,949,425 | A | 8/1990 | Dodson et al. | |
| 4,958,462 | A | 9/1990 | Cross | |
| 5,069,001 | A | 12/1991 | Makarowski | |

(Continued)

OTHER PUBLICATIONS

"One Size Does Not Fit All—Opening Windows to the World," Balance Systems—BSI, Amesbury Group Inc., Fenestration Magazine, May 2000.

(Continued)

*Primary Examiner*—Chuck Y. Mah
*Assistant Examiner*—Michael J. Kyle
(74) *Attorney, Agent, or Firm*—Wallenstein Wagner & Rockey, Ltd.

(57) ABSTRACT

A block and tackle sash balance assembly for providing a counterbalancing force to a sash window pivotally and slideably mounted within a sash window frame is disclosed. The assembly is adapted to disable the counterbalancing force responsive to pivoting of the sash window.

12 Claims, 6 Drawing Sheets

U.S. PATENT DOCUMENTS

| | | | | |
|---|---|---|---|---|
| 5,127,192 | A | | 7/1992 | Cross |
| 5,189,838 | A | | 3/1993 | Westfall |
| 5,251,401 | A | | 10/1993 | Prete et al. |
| 5,301,467 | A | | 4/1994 | Schmidt et al. |
| 5,353,548 | A | | 10/1994 | Westfall |
| 5,377,384 | A | | 1/1995 | Riegelman |
| 5,445,364 | A | | 8/1995 | Tibbals, Jr. |
| 5,448,858 | A | | 9/1995 | Briggs et al. |
| 5,452,495 | A | | 9/1995 | Briggs |
| 5,463,793 | A | | 11/1995 | Westfall |
| 5,530,991 | A | | 7/1996 | deNormand et al. |
| 5,632,117 | A | | 5/1997 | Prete et al. |
| 5,669,180 | A | | 9/1997 | Maier |
| 5,697,188 | A | | 12/1997 | Fullick et al. |
| 5,737,877 | A | | 4/1998 | Meunier et al. |
| 5,829,196 | A | | 11/1998 | Maier |
| 5,855,092 | A | | 1/1999 | Raap et al. |
| 5,873,199 | A | | 2/1999 | Meunier et al. |
| 6,026,617 | A | * | 2/2000 | Stark ..... 52/204.66 |
| 6,032,417 | A | | 3/2000 | Jakus et al. |
| 6,041,475 | A | | 3/2000 | Nidelkoff |
| 6,041,476 | A | | 3/2000 | deNormand |
| 6,119,398 | A | | 9/2000 | Yates, Jr. |
| 6,467,128 | B1 | | 10/2002 | Damani |
| 6,470,530 | B1 | | 10/2002 | Trunkle |
| 2002/0092241 | A1 | | 7/2002 | Uken et al. |
| 2002/0129463 | A1 | | 9/2002 | Newman |

OTHER PUBLICATIONS

"BSI's Hidden Advantage: It's as Easy as 1-2-3," Balance Systems—BSI, Amesbury Group, Inc., Fenestration Magazine, May 2001, vol. 14, No. 6, p. 33.

* cited by examiner

PRIOR ART

BLOCK AND TACKLE SASH BALANCE BRAKE ASSEMBLY

CROSS-REFERENCE TO RELATED APPLICATIONS

This application claims priority of U.S. Provisional patent application Ser. No. 60/347,640, filed Oct. 23, 2001.

FEDERALLY SPONSORED RESEARCH OR DEVELOPMENT

Not Applicable.

TECHNICAL FIELD

The present invention relates to a block and tackle type sash balance assembly, and more particularly, to a braking mechanism therefore.

BACKGROUND OF THE INVENTION

A sash window arrangement disposed within a frame is well known. The frame is comprised of a pair of opposed vertical tracks or jam. The tracks are adapted to slidably guide a pair of sash windows within the frame.

Various types of balance systems are known and are used to counterbalance the weight of the sash window. In particular, block and tackle counter balance assemblies are known and have become popular due to their combination of relatively compact size and ease of installation. The block and tackle balance combines a system of pulleys and an extension spring mounted within a rigid balance channel for conversion of a high spring tension applied over a short working distance to a lower tension applied over a longer working distance. The extension spring is anchored at one end of the balance channel and the pulley system is anchored at the other end of the channel.

A traditional arrangement utilizing a block and tackle balance is disclosed in U.S. Pat. No. 5,530,991 to deNormand. In deNormand '991, an end of the balance channel is is attached to the track via a hook or other intermediate structure. An end of a cord woven through the pulley system and extending from a second end of the channel is attached, via a hook or other intermediate structure, to a shoe. This shoe is in turn attached to the window sash and slides therewith, within the track. An inverted block and tackle counterbalance system is disclosed by U.S. Pat. No. 6,041,476 to deNormand. In this arrangement, the end of the cord extending from the channel is attached to the track via a hook or other intermediate structure. The balance channel is then attached to the sash shoe via a hook or other intermediate structure such that the balance channel slides within the track as the window slides within the frame.

If the sash is pivotable, typically the shoe includes a braking mechanism which expands within the channel, to prevent the sash from moving upwards when tilted. While such braking mechanisms are effective, they are relatively complex and expensive, and rely on friction for braking. This results in a need for tight part tolerances.

The present invention is provided to solve these and other problems.

SUMMARY OF THE INVENTION

It is an object of the invention to provide a braking sash balance assembly for a pivotable sash window disposed between a pair of shoe channels.

In accordance with one aspect of the invention, the pivotable sash window is pivotable between a first, generally vertical orientation and a second, generally non-vertical orientation. The braking sash balance assembly comprises a channel and means disposed within the channel for providing an upward bias on the sash window. The assembly further comprises a locking member movable with the upward biasing means. The locking member is pivotable between a first position in locking engagement with the channel and a second position disengaged from the channel.

In accordance with another aspect of the invention, the assembly comprises a channel and means disposed within the channel for providing an upward bias on the sash window. The assembly further comprises a locking member movable with the upward biasing means. The locking member is pivotable between a first position in locking engagement with the shoe channel and a second position disengaged from the shoe channel.

It is contemplated that the upward bias providing means comprises a block and tackle type balance assembly, although other assemblies could be used.

DETAILED DESCRIPTION OF THE INVENTION

Figure 1:
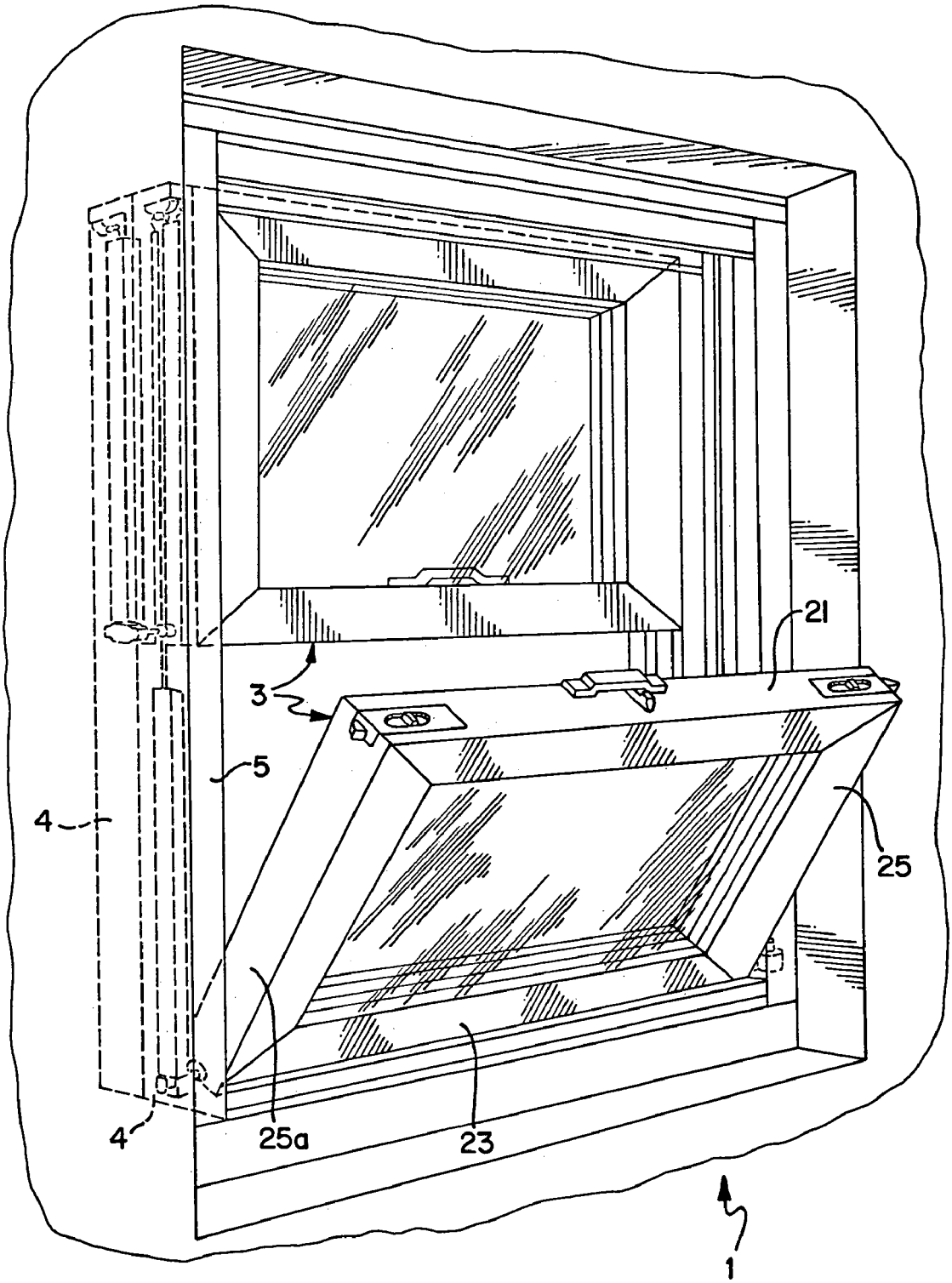
FIG. 1 is a perspective view of a double hung sash window assembly.

While this invention is susceptible of embodiment in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated.

FIG. 1 shows a double hung window assembly 1 having a pair of sash windows 3 slidably disposed in a master frame 5. Each sash window 3 is comprised of a top sash rail 21, a base sash rail 23 and a pair of vertical stiles 25 having outer stile walls 25*a*. The master frame 5 has two pair of vertical tracks or shoe channels 4. The sash windows 3 are pivotally mounted within the frame 5 between a vertical, or closed position (the upper sash window 3) and a non-vertical, or open position (the lower sash window 3). A block and tackle balance assembly 7 provides an upward force on the sash window 3, to counter the weight of the sash window 3.

Figure 1A:
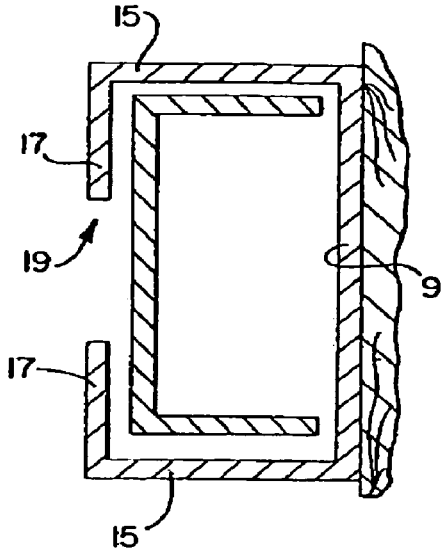
FIG. 1*a* is a cross-sectional view of a block and tackle balance channel in a sash window shoe channel.

Each vertical track or shoe channel 4, as illustrated in FIG. 1*a*, is comprised of a rear wall 9, a pair of lateral walls 15 and a front wall consisting of a pair of shoulders 17. The shoulders 17 are separated by a slot 19 extending substantially the length of the track or shoe channel 4.

Figure 2:
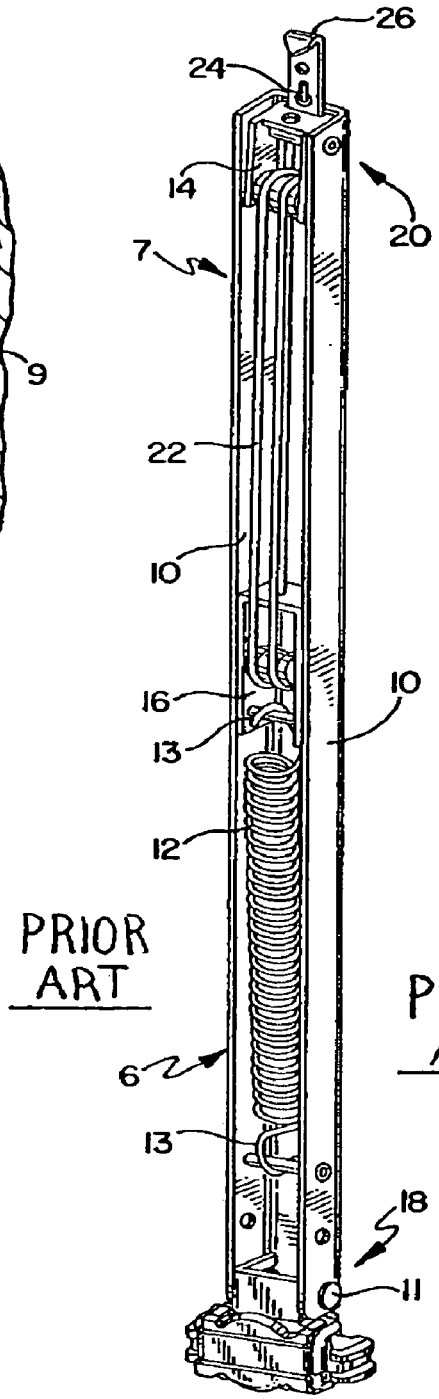
FIG. 2 is a front perspective view of a conventional block and tackle sash balance.
Figure 3:
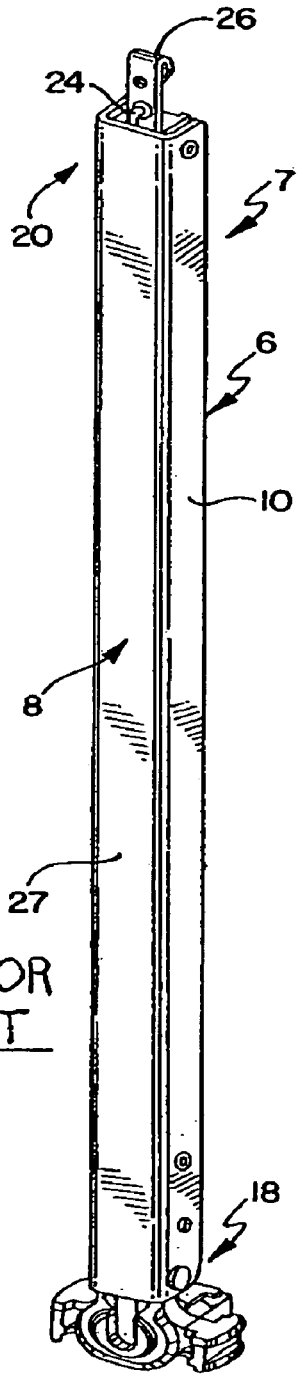
PRIOR ART FIG. 3
FIG. 3 is a rear perspective view of a conventional block and tackle sash balance assembly.

A conventional sash balance assembly 7 is illustrated in FIGS. 2 and 3. The conventional block and tackle balance assembly 7 generally includes a balance channel 6, an extension spring 12, a pulley system comprised of a first pulley block 14 and a second pulley block 16, and a cord 22. The balance channel 6 has a base 8, with an inner base surface 8*a* and an outer base surface 8*b*, and a pair of side walls 10. The balance channel 6 further has a first end 18 and a second end 20. At the first end 18, the balance channel 6 has a pair of openings 11, one each located in a respective side wall 10.

The extension spring 12 has a hook 13 formed in each end thereof. One end of the extension spring 12 is rigidly fixed to the balance channel 6 in the proximity of the first end 18 via a rivet or other suitable connecting means. The first pulley block 14 is rigidly fixed to the second end 20 of balance channel 6 via a rivet or other suitable connecting means. A second end of the extension spring 12, via the hook 13 formed therein, is attached to the second pulley block 16. The cord 22 is fixed to the second pulley block 16, and reeved alternatingly through the first pulley block 14 and second pulley block 16. A free end 24 of the cord 22 extends out of the balance channel 6 through its second end 20. Attached to the free end 24 is a jam hook 26 adapted to be connected to track 4.

Embodiments of the sash balance braking assembly according to the present invention are illustrated in FIGS. 4–12.

Figure 5:
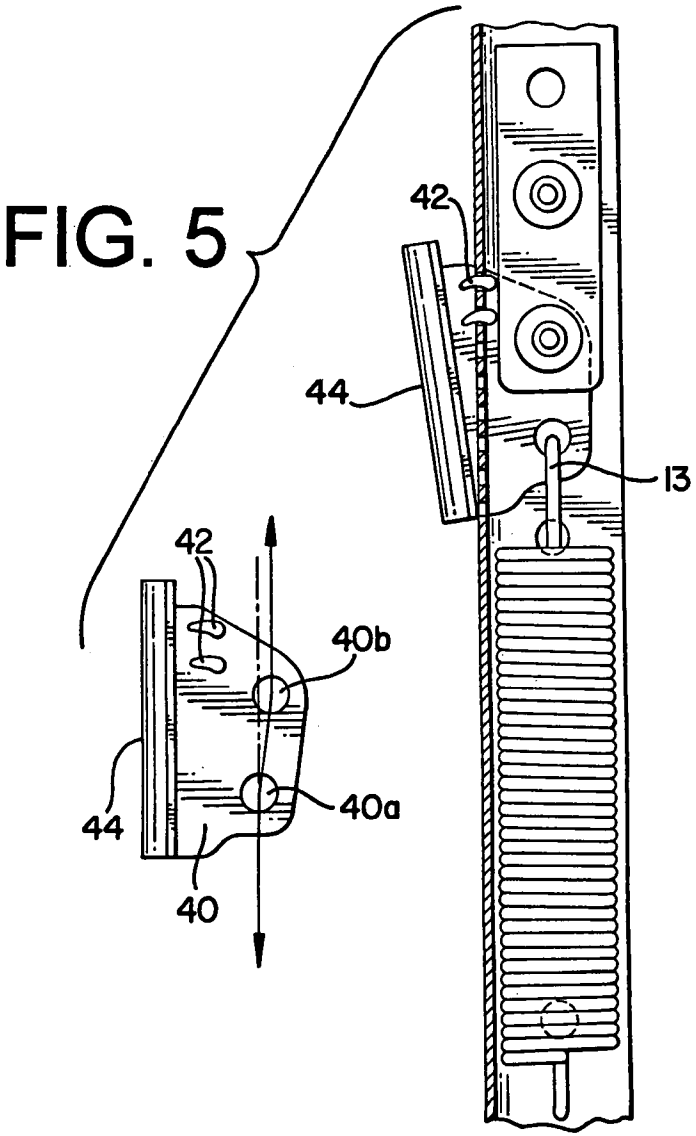
FIG. 5 is a side view of the balance assembly of FIG. 4.
Figure 4:
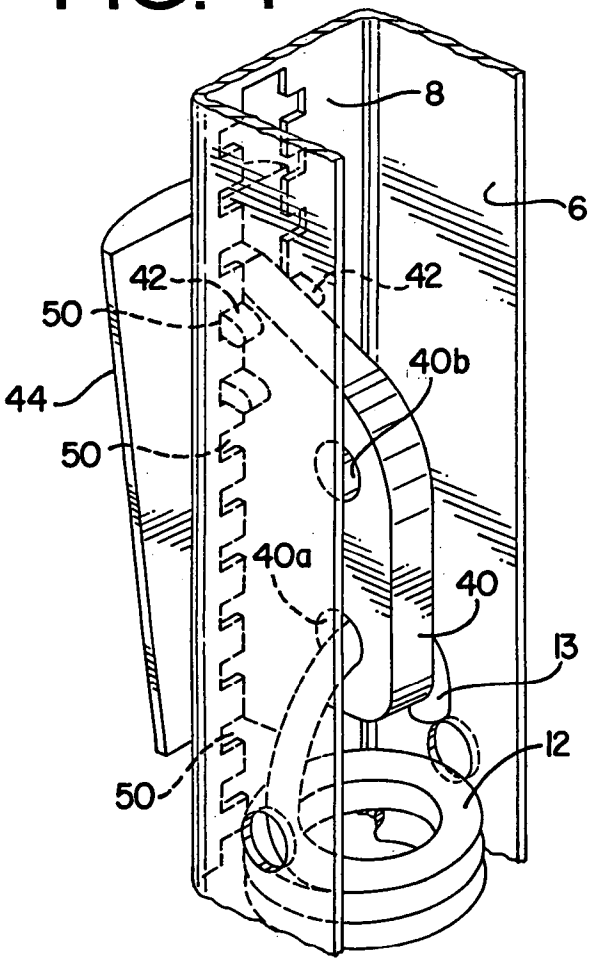
FIG. 4 is a perspective view of one embodiment of a locking member of a block and tackle balance assembly in accordance with the invention.
Figure 7:
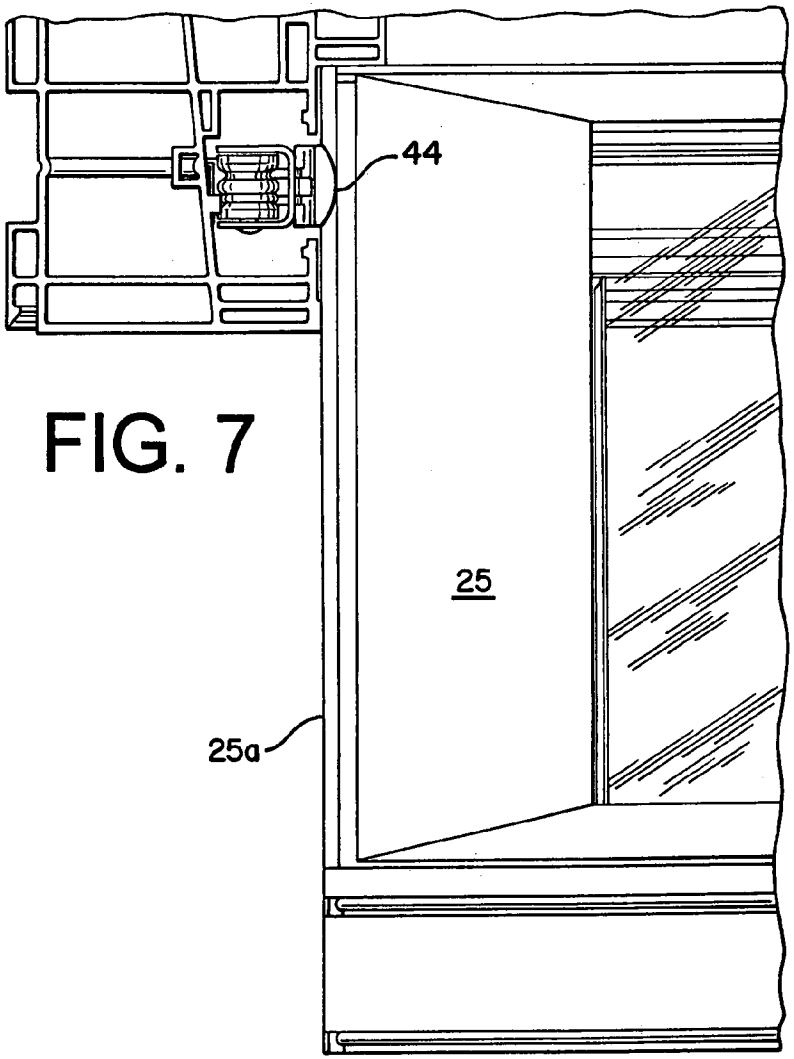
FIG. 7 illustrates the sash balance assembly of FIG. 4, located within a sash window shoe channel, with the sash window in the vertically open position.
Figure 6:
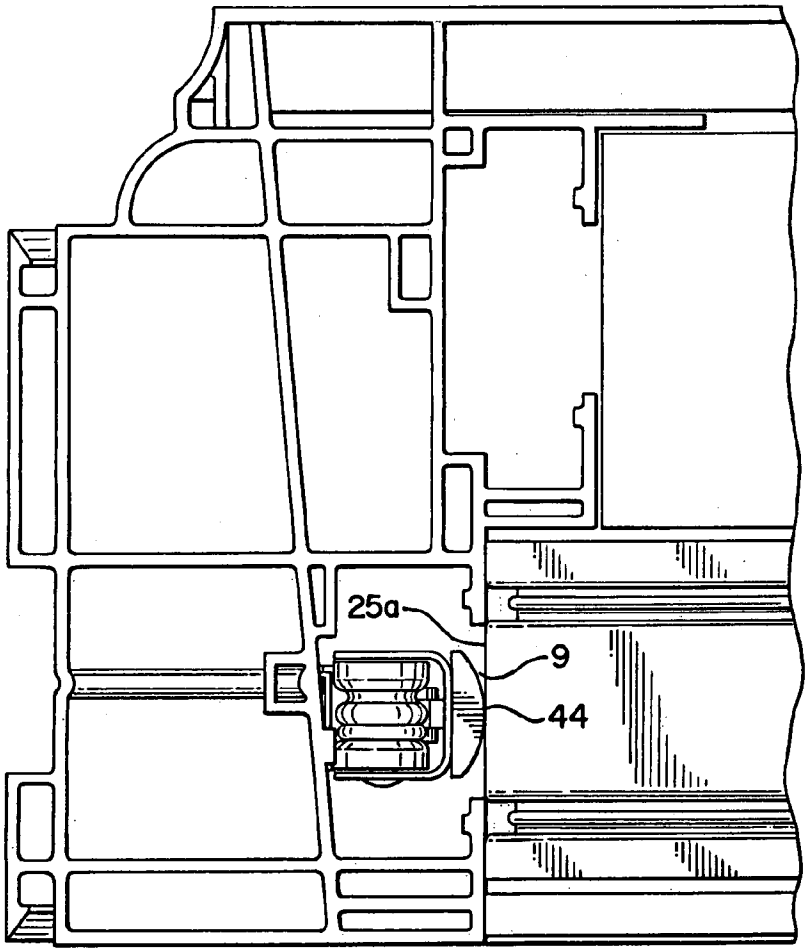
FIG. 6 illustrates the sash balance assembly of FIG. 4, located within a sash window shoe channel, with the sash window in the vertically closed position.
Figure 9:
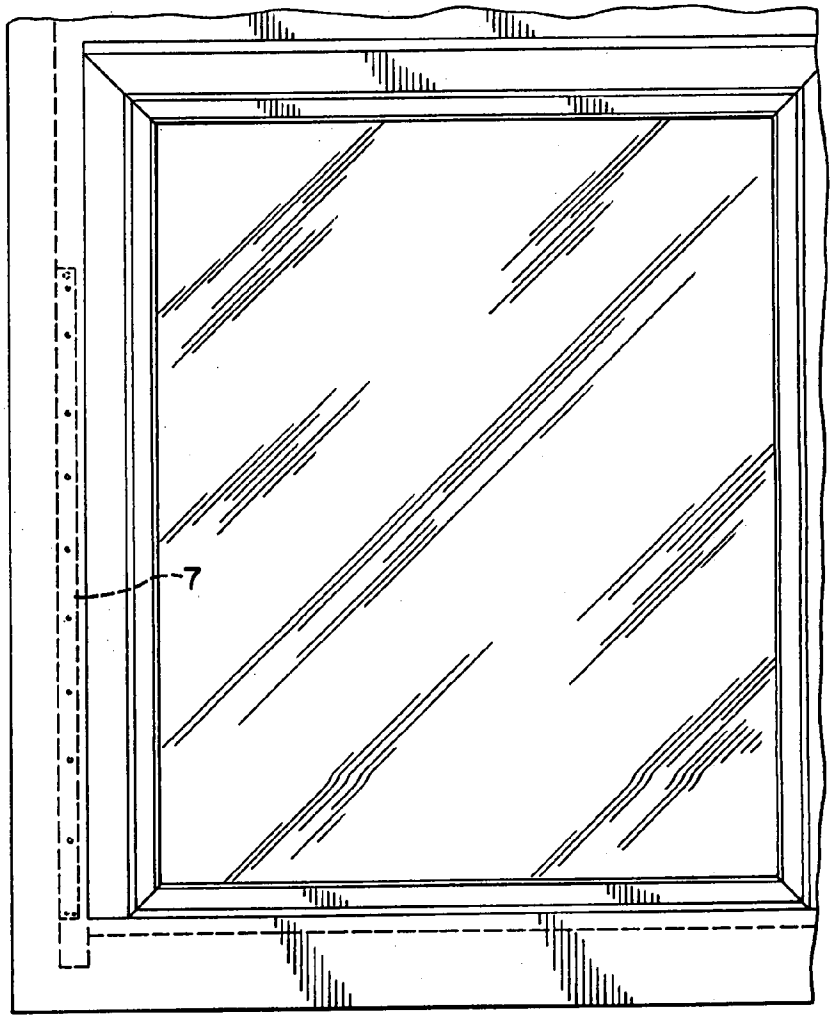
FIG. 9 illustrates the sash balance assembly of FIG. 4, located within a sash window shoe channel, with the sash window in the vertically closed position.
Figure 8:
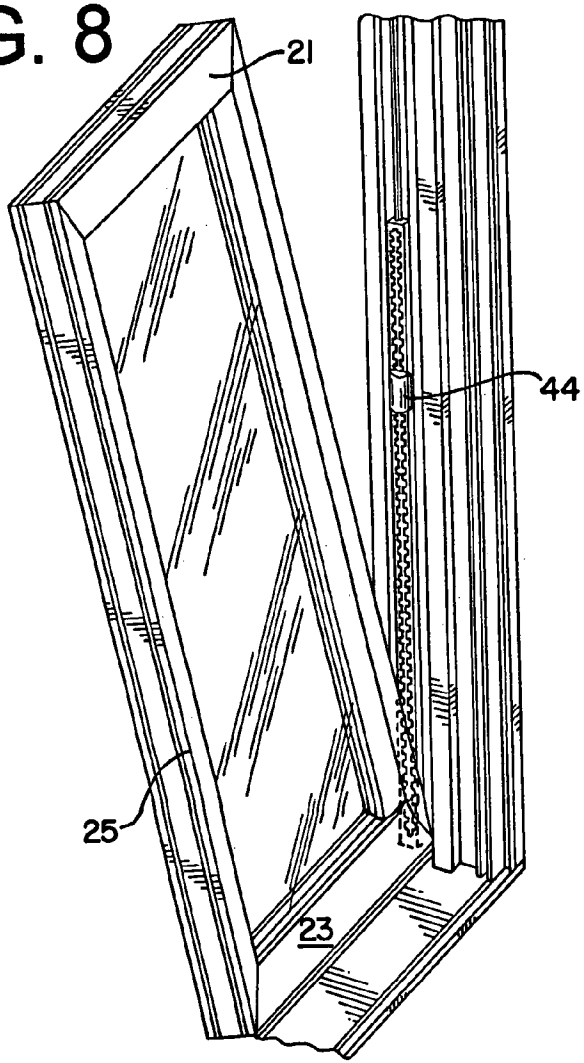
FIG. 8 illustrates the sash balance assembly of FIG. 4, located within a sash window shoe channel, with the sash window in the vertically open position.

Specifically, a locking member 40 is disposed between the upper spring hook 13 and the second pulley block 16, via upper and lower holes 40*a*, 40*b*, respectively. As shown in FIG. 5, the upper and lower holes 40*a*, 40*b*, are vertically offset, such that the spring force presents a pivotally outward bias. The locking member 40 can pivot between a vertical 'unlocked' position and a non-vertical 'locked' position. The locking member 40 includes a pair of teeth 42 on opposing sides thereof, and an engaging surface 44.

The base 8 of the balance channel 6 includes a series of equally spaced notches 50 along its length. As noted above, each of the sash windows 3 is pivotally mounted in the master frame 5 between a vertical, or closed, orientation and a non-vertical orientation. The notches 50 are dimensioned to receive the teeth 42. When the sash window 3 is in its closed orientation, the engaging surface 44 of the locking member 40 engages the respective outer stile wall 25*a*, opposing the pivotally outward bias, and maintaining the locking member 40 in its unlocked position. However, when the sash window 3 is in its open orientation, the engaging surface 44 of the locking member 40 is released from the respective outer stile wall 25', permitting the pivotally outward bias to move the locking member 40 to its locked position, wherein the teeth 42 engage the notches 50 at the particular location along the base 8.

When the teeth 42 engage the notches 50, the extension spring 12 is positively locked relative to the balance channel 6, thus removing the upward force of the extension spring 12 on the sash window 10.

Figure 10:
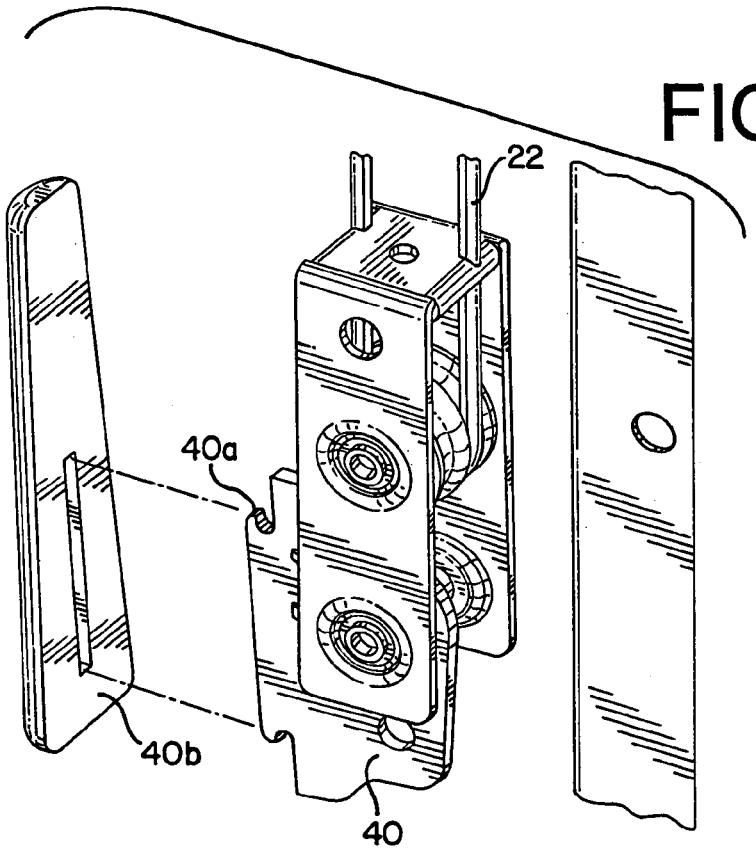
FIG. 10 illustrates a second embodiment of the locking member of the present invention.

One embodiment of the locking member 40 is illustrated in FIG. 5. According to this embodiment, the locking member 40 is a single piece construction of either plastic or metal. Another embodiment of the locking member 40 is illustrated in FIG. 10.

According to this embodiment, the locking member 40 is a two-piece construction, having a brake linkage 40*a* formed of stamped steel and a cap 40*b* of plastic.

In an alternative embodiment, instead of the notches 50, the inner base surface 8 could be serrated to engage the teeth 42.

Figure 11:
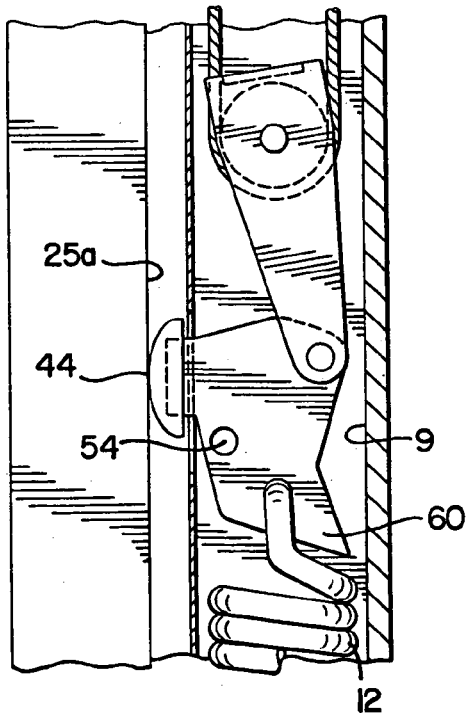
FIG. 11 illustrates a third embodiment of the locking member of the present invention, in its unlocked position.
Figure 12:
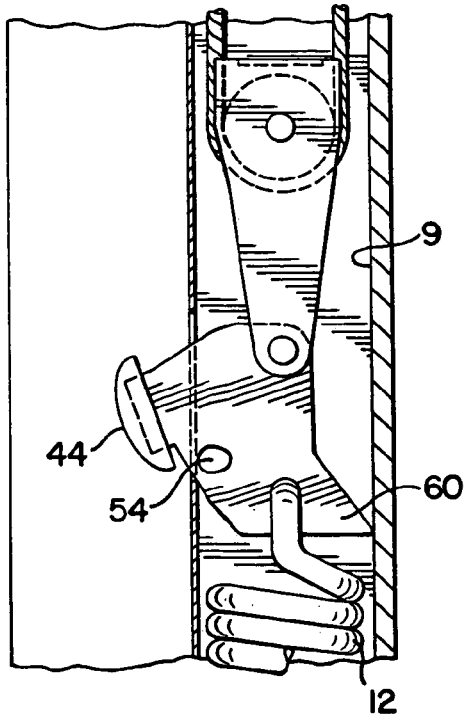
FIG. 12 illustrates the third embodiment of the locking member in its locked position.

A further embodiment of the locking member 40 is illustrated in FIGS. 11 and 12. According to this embodiment, the locking member 40 is pivotably mounted to a pivot pin 54 in the channel 6. The locking member 40 includes a tooth 60. The tooth 60 engages the rear wall 9 of the shoe channel 4 when the sash window 3 is in its open orientation, thus removing the upward force of the extension spring 12 on the sash window 10.

While the specific embodiments have been illustrated and described, numerous modifications come to mind without significantly departing from the spirit of the invention and the scope of protection is only limited by the scope of the accompanying claims.

We claim:

1. A locking block and tackle sash balance assembly for a sash window, the sash window pivotable between a pivotably closed orientation and a pivotably open orientation, the assembly comprising:

a channel;

a spring disposed within the channel;

a block and tackle assembly disposed within the channel, the assembly including a moveable pulley and a fixed pulley; and a locking member coupling the spring to the movable pulley; wherein the locking member is movable between a first position in locking engagement with the channel when the sash is in the open orientation and a second position disengaged from the channel when the sash is in the closed orientation.

2. The assembly of claim 1 including means for biasing the locking member towards the first position.

3. The assembly of claim 2 including means for retaining the locking member in the second position when the sash is in the second orientation.

4. The assembly of claim 3 wherein the retaining means comprises a surface of the locking member engaging the sash.

5. The assembly of claim 2 wherein the biasing means comprises off-center attachment of the locking member to the spring and the movable pulley.

6. The assembly of claim 1 wherein the channel has a plurality of spaced notches, and the locking member includes a tooth to engage one of the notches when the sash is in the open position.

7. The assembly of claim 1 wherein the channel has a plurality of serrations, and the locking member includes a tooth to engage one of the serrations when the sash is in the open position.

8. The assembly of claim 6, wherein the locking member includes a plurality of teeth to engage a respective plurality of the notches.

9. A sash balance assembly for providing a counterbalancing force to a sash window slidably and pivotally mounted within a frame, the sash window having a stile, the frame having a shoe channel having a rear wall and a front wall having a pair of shoulders separated by a slot, wherein the assembly is adapted to disable the counterbalancing force responsive to pivotal movement of the sash window, the sash balance assembly comprising:

a block and tackle balance assembly having a balance channel;

an active pulley block slidably positioned generally within the balance channel;

wherein the balance channel is adapted to prevent sliding movement of the active pulley block within the balance channel responsive to pivotal movement of the window sash; and, a locking member rotatably mounted to the active pulley block having a locked position and an unlocked position;

wherein the locking member is adapted to selectively engage the balance channel responsive to pivotal movement of the window sash.

10. The sash balance assembly of claim 9 comprising:

a plurality of protrusions extending from the locking member; and a plurality of notches in the balance channel;

wherein the protrusions are adapted to engage respective ones of the notches.

11. The sash balance assembly of claim 10 comprising:

an extension spring mounted generally within the balance channel, a first end of the extension spring connected to the balance channel and a second end of the extension spring connected to the locking member;

wherein the active pulley block, locking member and extension spring are adapted to bias the locking member in the locked position.

12. The sash balance assembly of claim 11 comprising:

an engagement pad integrally formed on the locking member adapted to engage the stile when the locking member is in its unlocked position and to extend through the slot when the locking member is in is locked position.

* * * * *